US011946200B2

(12) United States Patent
Kohl et al.

(10) Patent No.: US 11,946,200 B2
(45) Date of Patent: Apr. 2, 2024

(54) STRANDING MACHINE

(71) Applicant: Maschinenfabrik NIEHOFF GmbH & Co. KG, Schwabach (DE)

(72) Inventors: Jurgen Kohl, Kammerstein (DE); Mathias Schmidt, Kammerstein (DE); Helmut Lammermann, Schwabach (DE); Andreas Kraus, Schwabach (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 618 days.

(21) Appl. No.: 16/977,189

(22) PCT Filed: Apr. 1, 2019

(86) PCT No.: PCT/EP2019/058164
§ 371 (c)(1),
(2) Date: Sep. 1, 2020

(87) PCT Pub. No.: WO2019/197193
PCT Pub. Date: Oct. 17, 2019

(65) Prior Publication Data

US 2021/0001390 A1 Jan. 7, 2021

(30) Foreign Application Priority Data

Apr. 12, 2018 (DE) ..... 10 2018 205 566.1

(51) Int. Cl.
*D07B 3/02* (2006.01)
*B21F 7/00* (2006.01)
(Continued)

(52) U.S. Cl.
CPC ..... *D07B 3/02* (2013.01); *B21F 7/00* (2013.01); *D07B 3/085* (2013.01); *D07B 7/021* (2021.01);
(Continued)

(58) Field of Classification Search
CPC .... D07B 2201/2024; D07B 2401/2085; D07B 2401/2015; D07B 7/021; D07B 7/02;
(Continued)

(56) References Cited

U.S. PATENT DOCUMENTS 2,593,984 A * 4/1952 Clary, Jr. ..... H01B 13/0228 57/58.55
3,605,469 A * 9/1971 Queralto ..... D07B 5/12 148/645
(Continued)

FOREIGN PATENT DOCUMENTS

CN 105714586 A 6/2016
DE 2611938 A1 9/1977
(Continued)

OTHER PUBLICATIONS

Machine translation—JP2014227288 (Year: 2014).*
(Continued)

*Primary Examiner* — Khoa D Huynh
*Assistant Examiner* — Uyen T Nguyen
(74) *Attorney, Agent, or Firm* — Wood Herron & Evans LLP

(57) ABSTRACT

A stranding machine is provided for producing a cord from a plurality of wires, preferably metal wires. The stranding machine has a stranding device for stranding the wires, including at least one rotatably mounted deflecting roller for deflecting the cord and at least one guide device for guiding the cord. The guide device is arranged in such a way that the cord can be guided on a straight line from the guide device to the deflecting roller in such a way that the cord is pressed against a first flank of the deflecting roller. As the cord is deflected by the deflecting roller, the cord moves from the first flank into the roller base of the deflecting roller.

8 Claims, 1 Drawing Sheet

(51) Int. Cl.
*D07B 3/08* (2006.01)
*D07B 7/02* (2006.01)

(52) U.S. Cl.
CPC ..... *D07B 2201/2024* (2013.01); *D07B 2201/2033* (2013.01); *D07B 2401/2085* (2013.01)

(58) Field of Classification Search
CPC ..... D07B 7/10; D07B 2207/4018; D07B 2207/4072; D07B 3/10; D07B 3/02; D07B 3/085; D07B 2501/406
USPC ..... 57/311
See application file for complete search history.

(56) References Cited

U.S. PATENT DOCUMENTS 4,407,116 A * 10/1983 Henrich ..... D07B 7/02 57/127.5
4,590,752 A * 5/1986 Aubert ..... B65H 81/08 140/71 C
4,887,421 A * 12/1989 Haislet ..... D07B 3/00 57/58.57
5,802,830 A * 9/1998 Kawatani ..... B60C 9/0007 57/902
2006/0151081 A1* 7/2006 Ueda ..... D07B 3/12 57/66
2018/0237988 A1 8/2018 Lammermann et al.

FOREIGN PATENT DOCUMENTS

| | | | | |
|---|---|---|---|---|
| EP | 0791682 | A1 | | 8/1997 |
| EP | 1441063 | A1 | | 7/2004 |
| EP | 3029197 | A1 | | 6/2016 |
| GB | 1567699 | A | | 5/1980 |
| JP | 2003306880 | A | | 10/2003 |
| JP | 2004292971 | A | | 10/2004 |
| JP | 2014227288 | A | * | 12/2014 |
| JP | 2018507515 | A | | 3/2018 |

OTHER PUBLICATIONS

International Bureau, Notification Concerning Submission, Obtention or Transmittal of Priority Document issued is PCT/EP2019/051864 dated Apr. 17, 2019 (1 page).
International Searching Authority, Written Opinion and Search Report issued is PCT/EP2019/051864, dated Jun. 12, 2019 (15 pages).
International Breau, Notification of the Recording of a Change issued is PCT/EP2019/051864, dated Jun. 29, 2020 (5 page).
Japanese Patent Office, Office Action issued in JP 2020-548706 dated Oct. 24, 2022 with English Translation (10 pages).

* cited by examiner

STRANDING MACHINE

CROSS-REFERENCE TO RELATED APPLICATIONS

This application is a national phase entry of, and claims priority to, International Application No. PCT/EP2019/058164, filed Apr. 1, 2019, which claims priority to DE 10 2018 205 566.1 filed Apr. 12, 2018. The above-mentioned patent applications are incorporated herein by reference in their entireties.

TECHNICAL FIELD

This application relates to a stranding machine for producing a cord from a plurality of wires, preferably metallic wires. For example, in such a stranding machine, a plurality of such wires are stranded together by twisting, i.e. processed to form a cord, and the wires are preferably made of a copper alloy, particularly preferably a copper-magnesium or copper-tin alloy, for example with a content of 0.2 or 0.3% of magnesium or tin, or, equally preferably, of a copper-silver alloy.

BACKGROUND

A stranding machine of the type described in this application includes a stranding device for stranding the wires.

The stranding device preferably has a revolving rotor which comprises an elongated flyer bow that is curved radially outwards and is rotatably supported at both of its ends. The plurality of wires is fed to the rotor and guided over the flyer bow, as a result of which the wires are twisted at one or more stranding points.

The stranding machine preferably includes a rotatably mounted draw-off (or drawing) disc for drawing the cord off from the stranding device. The draw-off disc is preferably driven to generate the required tensile stress for drawing off the cord.

After the cord has been drawn off from the stranding device, the cord is preferably wound onto a bobbin with the aid of a suitable winding device, or is directly further processed. If the cord is wound onto a bobbin, the latter generally comprises a cylindrical spool core for winding the cord onto and, at the two ends of the spool core, one disc-shaped flange, respectively, to prevent the windings from slipping off the spool core. During the winding with the cord, the bobbin rotates generally around the longitudinal axis of the spool core (hereinafter referred to as "bobbin axis").

In particular, in the case of stranding machines of the above-described type, having a flyer bow, which are operated as double twist stranding machines, the drawing-off disc, if applicable, and, if applicable, also the winding device and the bobbin for winding the cord, are preferably arranged within the rotational volume of the flyer bow, i.e. within the space around which the flyer bow rotates. Therefore, only limited space is available for the drawing-off disc, the winding device and/or the bobbin. The bobbin axis can be arranged substantially orthogonally to the rotor axis, substantially parallel to the rotor axis or else in a different angular position relative to the rotor axis. The cord preferably emerges from the rotor along the rotor axis.

In respect to the cord as produced, one problem arises that the cord may have a twist. In addition, in the unloaded state, the cord tends to bend, tends to "curl" or tends to display "rollovers", i.e. loop formations.

This is problematic in the further processing of the cord, in particular during the winding onto a bobbin, during assembly and during crimping, i.e. when connectors are clamped onto the cord.

In addition, the process of extrusion, i.e. the casting of a plastic insulation around the cord in an extrusion process, is made more difficult as a result. In particular, the phenomena mentioned above impede the use of so-called "bag discharges" during extrusion, which operate continuously, instead of rotating tangential discharges which do not operate continuously and only permit a significantly smaller feed speed of the cord.

Finally, the twist and the tendency of the cord to "curl" reduce the number of alternating bending cycles achievable, i.e. the number of alternating bending cycles which can be carried out without material fatigue or failure.

It would therefore be desirable to provide a stranding machine and a process for producing a cord, such that the cord produced has, at most, a low twist and a low tendency to "curl."

SUMMARY

To address these and other problems with conventional designs as identified above, a stranding machine and a process for producing a cord are provided in accordance with embodiments of the present invention.

Embodiments of the invention are based on the observation that the twist and the tendency of the cord to "curl" can be reduced by a movement in the direction of the torsion of the cord resulting from the twisting, referred to below as "twisting torsion", preferably in conjunction with a stretch forming of the cord, i.e. a stretching which leads to a plastic deformation of the cord.

In the stranding machine according to embodiments of the invention, and in the method according to embodiments of the invention for producing a cord, at least one measure is therefore implemented which takes into account this observation.

A stranding machine according to embodiments of the invention includes at least one rotatably mounted deflecting roller for deflecting the cord and at least one guiding device for guiding the cord. The guiding device is arranged in such a way that the cord can be guided, on a straight line, from the guiding device to the deflecting roller, in such a way that the cord is pressed against a first flank of the deflecting roller.

The deflecting roller is of a conventional design, wherein the running surface for the cord (on the end face of the deflecting roller) has a wedge-shaped recess, in respect to its cross-section. The wedge-shaped recess has a first flank and a second flank that is directed obliquely inwards towards the central plane of the deflecting roller. The area near the inner edges of the two flanks, in which the radius of the running surface is smallest, is referred to as the roller base.

During the deflection by the deflecting roller, the cord moves on its way from the point of entry to the point of exit from the first flank of the deflecting roller into the roller base. To provide an illustrative description, the cord "slips" down along the first flank into the roller base. Thereby, the cord is subjected to a movement that is in conjunction with or against the twisting torsion. By selecting the first flank out of the two flanks of the running surface of the deflecting roller accordingly, it can be achieved that the movement of the cord takes place in conjunction with the twisting torsion, as a result of which the tendency of the cord to "curl" is reduced.

In one embodiment of the invention, additionally, a pulling device is arranged behind the deflecting roller in the direction of movement of the cord, wherein said pulling device is suitable for exerting a tensile force on the cord running off the deflecting roller. This results in a stretch forming of the cord, i.e. a stretching which leads to a plastic deformation of the cord, as a result of which the tendency of the cord to "curl" is likewise reduced.

The pulling device is preferably a winding device. Such a winding device is already provided in many stranding machines anyway, in order to wind up the cord as produced. The winding device allows to exert the desired tensile force onto the cord as the same is running off the deflecting roller, in particular by a driven bobbin axis in the winding device.

In a further embodiment of the invention, a contact point of the cord on the guiding device, from which the cord can be guided on a straight line to the deflecting roller in such a way that the cord is pressed against the first flank of the deflecting roller, is offset with respect to the central plane of the deflecting roller. As a result, the cord runs off-center onto the deflecting roller and, in this way, is pressed by itself against the first flank of the deflecting roller, without the need of a further pressing device.

In a further embodiment of the invention, the guiding device is arranged in such a way that the cord can be guided on a straight line from the guiding device to the deflecting roller in such a way that the cord is pressed against a second flank of the deflecting roller, which second flank is different from the first flank. The cord can thus selectively be pressed against the first or against the second flank of the deflecting roller. This selection can be carried out depending on the lay of the cord, i.e. depending on the direction in which the individual wires are twisted together during the stranding and from which direction also the twisting torsion depends. In this respect, a distinction is made between the so-called S-stranding, in which the wires are wound around one another in a counterclockwise direction, and the so-called Z-stranding, in which the wires are wound around one another in a clockwise direction, this property being invariant with respect to the direction in which the cord is viewed.

The guiding device is preferably movable relative to the deflecting roller, in particular movable substantially orthogonally to the central plane of the deflecting roller. In this way, the contact point of the cord on the guiding device can be fine-tuned relative to the deflecting roller. Further preferably, the flank of the deflecting roller against which the cord is to be pressed can also be selected in this way.

Additionally or alternatively, the selection of the flank of the deflecting roller against which the cord is to be pressed can also be made by guiding the cord along different sides of the guiding device.

In a further embodiment of the invention, the guiding device is a rotatably supported guiding roller. As a result, the friction of the cord relative to the guiding device can be reduced.

In other embodiments, a process is provided for producing a cord from a plurality of wires, preferably metallic wires, where the process is to be carried out on a stranding machine according to the description herein. In the process, the wires are stranded in the stranding device, the cord is guided from the stranding device to the guiding device, the cord is guided on a straight line from the guiding device to the deflecting roller, in such a way that the cord is pressed against the first flank of the deflecting roller, the cord is deflected by the deflecting roller, and the cord is guided away from the deflecting roller.

During the deflecting by the deflecting roller, the cord preferably moves from the first flank into the roller base of the deflecting roller.

As a result of guiding the cord in that manner, the twist and the tendency of the cord to "curl" are reduced, based on the above-described mechanisms.

BRIEF DESCRIPTION OF THE DRAWING

The accompanying drawing, which is incorporated in and constitutes a part of this specification, illustrates one or more embodiments of the invention and, together with the general description given above and the detailed description given below, explains the one or more embodiments of the invention.

DETAILED DESCRIPTION

Figure 1:
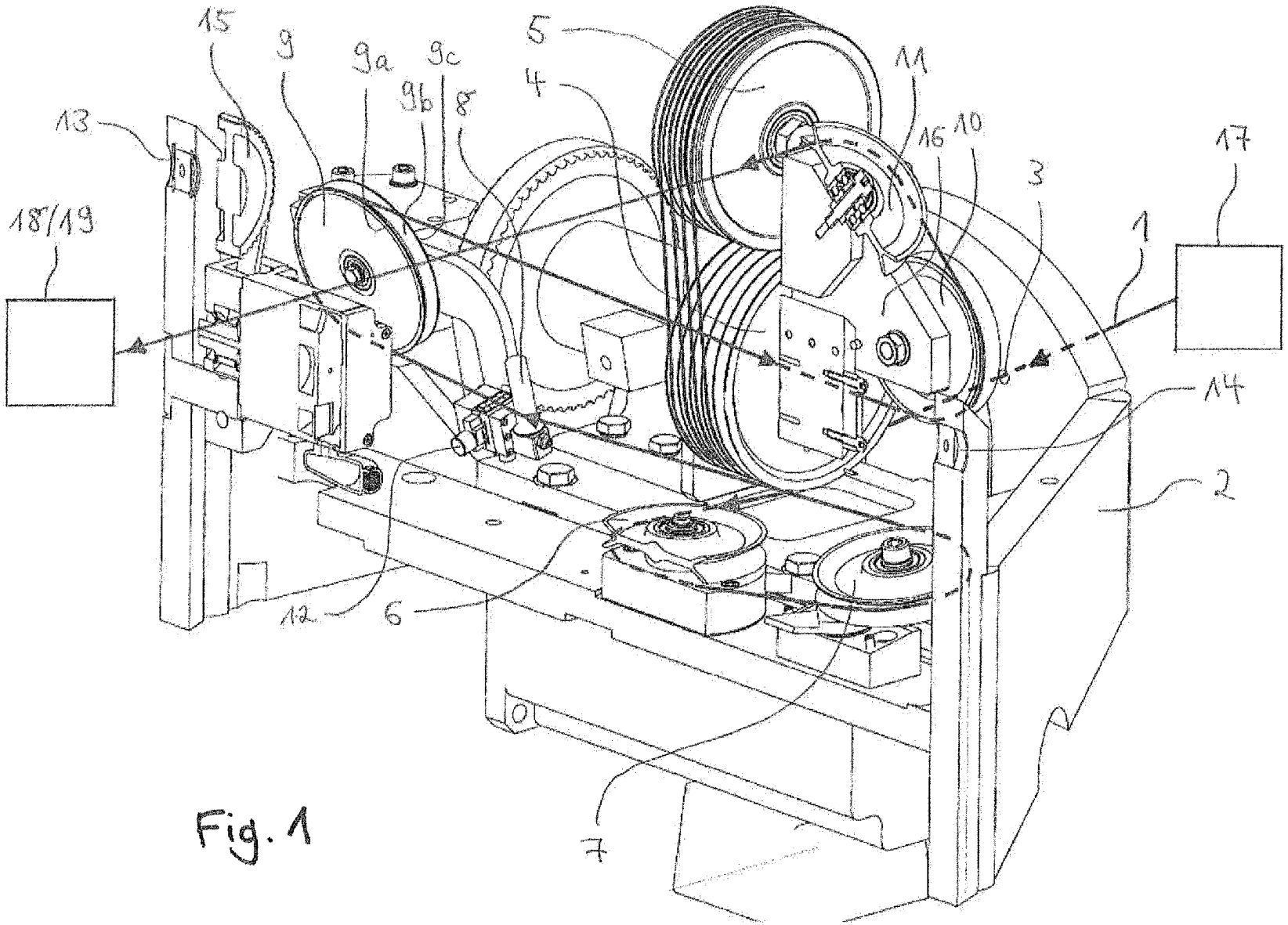
FIG. 1 is a perspective view of a section of a stranding machine according to one embodiment of the invention, illustrating the path of the cord.

FIG. 1 illustrates the path of the cord through a stranding machine according to one embodiment of the invention, which, in this exemplary embodiment, is preferably a double twist stranding machine. The stranding machine includes a stranding device 17 in which a rotor rotates, having a flyer bow (not shown). Inside of the rotational volume of the flyer bow, a housing 2 is suspended at a left end and at a right end by two rotor shaft bearing housings on two separate rotor shaft sections (both not shown).

The cord 1 runs through an opening 3 in the housing 2 to a draw-off disc 4, which is driven and which draws the cord 1 off the stranding device 17 by way of exerting tensile stress. The draw-off disc 4 and a lift-off roller 5 arranged above the draw-off disc 4 and parallel to the latter each comprise a plurality of running grooves, through which the cord 1 is alternatingly guided, so that the cord 1 passes through the draw-off disc 4 and the lift-off roller 5, alternatingly and altogether multiple times. The draw-off disc 4 and the lift-off roller 5 function as a first torsion lock.

The cord 1 then passes through two deflecting rollers 6 and 7 and is thereby deflected overall by 270 degrees. In this case, the deflecting roller 7 is slightly slanted so that the cord running off from the deflecting roller 7 does not collide with the cord running onto the deflecting roller 6.

Thereafter, the cord 1 runs along one side—in the exemplary embodiment along the left side—of a rotatable guiding roller 8, the axis of which extends approximately vertically. The guiding roller 8 has the effect that the cord 1 is deflected slightly out of its path and does not run centrally onto the following deflecting roller 9, but is pressed against a first flank 9*a* or a second flank 9*c* of the deflecting roller 9, in the exemplary embodiment against the left flank 9*a* as seen in the running direction of the cord 1. The position of the guiding roller 8 relative to the deflecting roller 9 can be fine-tuned by a vernier 12. With the aid of the vernier 12, the axis of the guiding roller 8 can be moved back and forth substantially orthogonally to the center plane of the deflecting roller 9.

The cord 1 wraps around the deflecting roller 9 by slightly less than 180 degrees. On its path from the point of entry onto the deflecting roller 9 on the left flank 9*a* to the point of exit, the cord 1 moves from the flank 9*a* into the roller base 9*b*. In doing so, the cord 1 moves in conjunction with the twisting torsion, as a result of which the above-described tendency of the cord to "curl" is reduced.

The stranding machine also comprises a traverse mechanism 16 having further deflecting rollers 10 and 11, which can be moved along a traverse axis on a spindle (not shown). The spindle is supported in two bearings 13, 14 (shown in a sectional cut in FIG. 1) and is driven by a drive wheel 15 (also shown as a sectional cut). The spindle runs parallel to the bobbin axis of the winding bobbin of a winding device 19 acting as a pulling device 18.

The cord 1 runs off from the deflecting roller 9 parallel to the spindle of the traverse mechanism 16 and thus runs onto the deflecting roller 10 of the traverse mechanism 16 always at the same angle, irrespective of the displacement position of the traverse mechanism 16. By the deflecting rollers 10 and 11, the cord 1 is again deflected in order to finally be guided to the winding device 19 and to be wound onto the winding bobbin thereof (not shown) at the axial position of the winding bobbin predetermined by the displacement position of the traverse mechanism 16.

Therein, the driven winding bobbin exerts a tensile force onto the cord 1, as a result of which the cord 1 is pressed against the deflecting roller 9, preferably with a high pressing force, and is thus slightly stretch formed between the deflecting roller 9 and the winding bobbin, typically by 2% to 3%. In this way, the helical structure which is imposed on the cord due to the twisting is further minimized or even completely removed. Insofar, the deflecting roller 9 functions as a (second) torsion barrier.

The embodiments described above are only descriptions of preferred embodiments of the present invention, and are not intended to limit the scope of the present invention. Various variations and modifications can be made to the technical solution of the present invention by those of ordinary skill in the art without departing from the design and spirit of the present invention. The variations and modifications should all fall within the claimed scope defined by the claims of the present invention.

What is claimed is:

1. A stranding machine for producing a cord from a plurality of metallic wires, comprising:

a stranding device for stranding the metallic wires, at least one rotatably supported deflecting roller for deflecting the cord, and at least one guiding device for guiding the cord, wherein the at least one guiding device is arranged in such a way that the cord can be guided on a straight line from the at least one guiding device to the at least one deflecting roller, in such a way that the cord is selectively pressed against a first flank or against a second flank, wherein the second flank is different from the first flank, of the at least one deflecting roller, the at least one deflecting roller defines a running surface having a wedge-shaped recess defined by each of the first and second flanks being directed obliquely inward towards a central plane of the at least one deflecting roller, with a roller base formed in an area extending between inner edges of the first and second flanks, the roller base having a smallest radius of the running surface, wherein the at least one guiding device is moveable relative to the at least one deflecting roller, with this movement of the at least one guiding device causing the selection of one of the first flank and the second flank of the at least one deflecting roller against which the cord is to be pressed, such that movement of the at least one guiding device switches the cord from pressing against the first flank to pressing against the second flank, wherein the cord formed from the metallic wires is guided by running across the running surface of the at least one deflecting roller so that the cord moves from a point of entry to a point of exit, and wherein the cord moves from contact with the first or second flank at the point of entry to contact with the roller base at the point of exit.

2. The stranding machine according to claim 1, wherein a pulling device is arranged behind the at least one deflecting roller in a direction of movement of the cord, the pulling device being suitable for exerting a tensile force on the cord running off the at least one deflecting roller.

3. The stranding machine according to claim 2, wherein the pulling device is a winding device.

4. The stranding machine according to claim 1, wherein a contact point of the cord on the at least one guiding device, from which the cord can be guided on a straight line to the at least one deflecting roller in such a way that the cord is pressed against the first flank of the at least one deflecting roller, is offset with respect to the central plane of the at least one deflecting roller.

5. The stranding machine according to claim 1, wherein the at least one guiding device is a rotatably supported guiding roller.

6. A process for producing a cord from a plurality of metallic wires to be carried out on a stranding machine including a stranding device for stranding the metallic wires, a rotatably supported deflecting roller including a first flank and a second flank different from the first flank, and a guiding device, the method comprising:

stranding the metallic wires in the stranding device, guiding the cord from the stranding device to the guiding device, guiding the cord on a straight line from the guiding device to the deflecting roller in such a way that the cord is pressed against either the first flank or the second flank of the deflecting roller, the deflecting roller defining a running surface having a wedge-shaped recess defined by each of the first and second flanks being directed obliquely inward towards a central plane of the deflecting roller, with a roller base formed in an area extending between inner edges of the first and second flanks, the roller base having a smallest radius of the running surface, deflecting the cord by the deflecting roller, wherein the deflecting includes running the cord formed from the metallic wires across the running surface of the deflecting roller so that the cord moves from a point of entry to a point of exit, and wherein the cord moves from contact with the first or second flank at the point of entry to contact with the roller base at the point of exit, and guiding the cord away from the deflecting roller, wherein the method further comprises:

moving the guiding device relative to the deflecting roller, the movement of the guiding device causing selective switching of one of the first flank and the second flank of the deflecting roller against which the cord is to be pressed, such that movement of the guiding device switches the cord from pressing against the first flank to pressing against the second flank during the deflecting by the deflecting roller.

7. The stranding machine according to claim 1, wherein the at least one guiding device is moveable substantially orthogonally to the central plane of the at least one deflecting roller.

8. The stranding machine according to claim 3, wherein a contact point of the cord on the at least one guiding device, from which the cord can be guided on a straight line to the at least one deflecting roller in such a way that the cord is pressed against the first flank of the at least one deflecting roller, is offset with respect to the central plane of the at least one deflecting roller, wherein the at least one guiding device is arranged in such a way that the cord can be guided on a straight line from the at least one guiding device to the at least one deflecting roller in such a way that the cord is pressed against the second flank of the at least one deflecting roller, wherein the second flank is different from the first flank, wherein the at least one guiding device is moveable substantially orthogonally to the central plane of the at least one deflecting roller, and wherein the at least one guiding device is a rotatably supported guiding roller.

* * * * *